US007859382B2

(12) United States Patent
Koprivnak et al.

(10) Patent No.: US 7,859,382 B2
(45) Date of Patent: Dec. 28, 2010

(54) PLANAR TRANSFORMER

(75) Inventors: George Bradley Koprivnak, Painesville, OH (US); Thomas David Williams, Hudson, OH (US)

(73) Assignee: Lincoln Global, Inc., City of Industry, CA (US)

( * ) Notice: Subject to any disclaimer, the term of this patent is extended or adjusted under 35 U.S.C. 154(b) by 0 days.

(21) Appl. No.: 12/571,760

(22) Filed: Oct. 1, 2009

(65) Prior Publication Data

US 2010/0079233 A1 Apr. 1, 2010

Related U.S. Application Data

(63) Continuation-in-part of application No. 12/238,492, filed on Sep. 26, 2008.

(51) Int. Cl.
*H01F 5/00* (2006.01)
*H01F 27/28* (2006.01)

(52) U.S. Cl. ..... 336/200; 336/170; 336/232

(58) Field of Classification Search ..... 336/170, 336/200, 232
See application file for complete search history.

(56) References Cited

U.S. PATENT DOCUMENTS 2,911,605 A 11/1959 Wales, Jr.
5,175,525 A * 12/1992 Smith ..... 336/83
5,754,088 A 5/1998 Fletcher et al.
5,949,321 A 9/1999 Grandmont et al.
5,952,909 A 9/1999 Umeno et al.
6,073,339 A * 6/2000 Levin ..... 29/606
6,211,767 B1 4/2001 Jitaru
6,628,531 B2 9/2003 Dadafshar
6,636,140 B2 10/2003 Fujiyoshi et al.
6,882,260 B2 4/2005 Katzir et al.
2003/0132825 A1 * 7/2003 Gamou ..... 336/223

FOREIGN PATENT DOCUMENTS

JP 05291044 A * 11/1993
JP 10163039 A * 6/1998

* cited by examiner

*Primary Examiner*—Anh T Mai
*Assistant Examiner*—Tszfung Chan
(74) *Attorney, Agent, or Firm*—Hahn Loesner & Parks LLP

(57) ABSTRACT

A planar transformer includes first and second windings that may be comprised of electrically conductive traces etched onto one or more printed circuit boards. The printed circuit boards may be arranged in various orientations so as to change the turns ratio of the planar transformer. In one embodiment, the printed circuit boards are substantially similar and may be electrically connected via connectors that separate the circuit boards. Insulating sleeves may be inserted between the printed circuit boards in an interleaved configuration.

2 Claims, 8 Drawing Sheets

PLANAR TRANSFORMER

This patent application is a continuation-in-part of patent application Ser. No. 12/238,492 filed on Sep. 26, 2008, which is incorporated herein by reference in its entirety.

TECHNICAL FIELD

The present invention pertains to electrical transformers, and more particularly, to planar transformers having a modular configuration.

BACKGROUND OF THE INVENTION

Planar transformers provide simplified solutions for compact electrical devices and have a generally planar form incorporating a larger number of coils as a printed circuit than can be fit into the equivalent space of round cross-sectional wire. Planar printed circuits afford many design options, one of which allows the coil to take any shape and width. Wide conductors make higher current flow possible. Thin conductors significantly reduce the transformer's weight. Still, one inflexible aspect of such devices relates to the design of the turns ratio. Whereas round wire wound onto a core provides a certain degree of design flexibility, new printed circuits must be fabricated for each coil pattern desired resulting in additional time and cost.

BRIEF SUMMARY

In one embodiment a planar transformer includes one or more sheets of dielectric material having individually formed electrically conductive traces that define magnetically coupled primary and secondary windings. First and second sets of connector ends extends from the one or more sheets of dielectric material, where the first and second sets of connector ends are connected to the primary and second windings respectively for electrical connection with associated circuitry. An auxiliary winding is formed on the one or more sheets of dielectric material and is magnetically coupled with the primary and/or secondary winding, wherein the auxiliary winding includes a third set of connector ends that is offset with respect to the first and second set of connector ends.

DETAILED DESCRIPTION OF THE INVENTION

Figure 1:
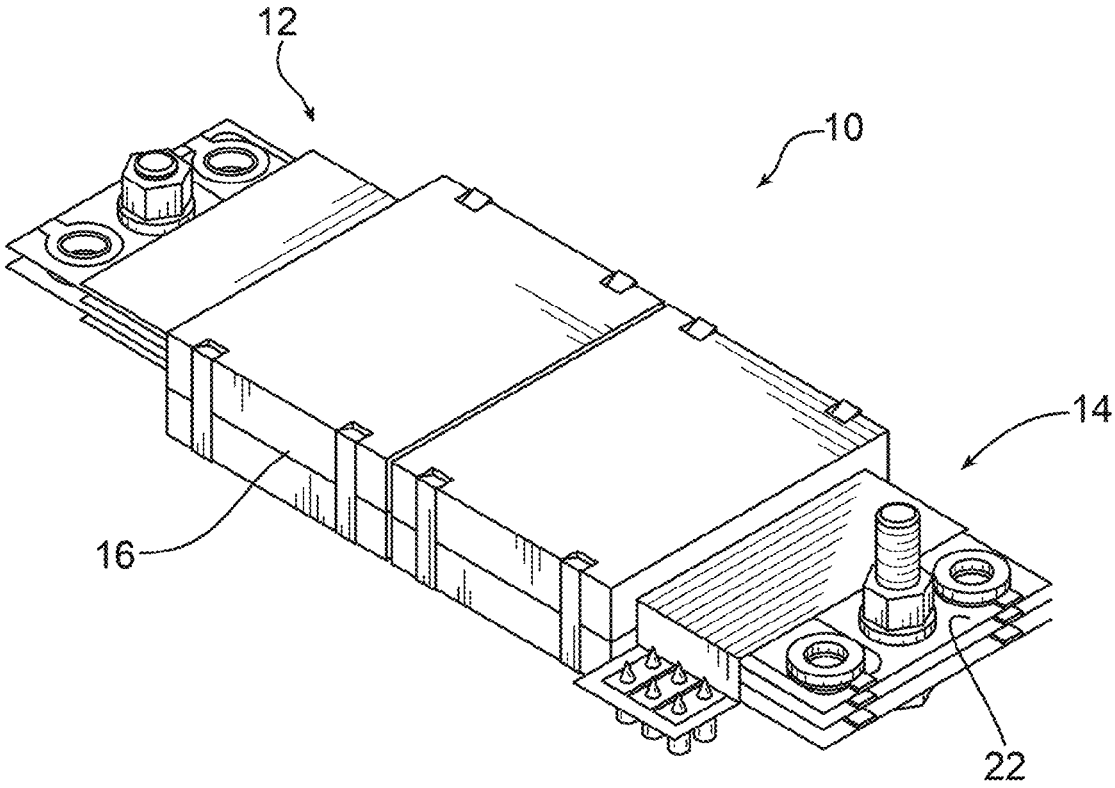
FIG. 1 is a perspective view of a planar transformer, according to the embodiments of the subject invention.

Referring now to the drawings wherein the showings are for purposes of illustrating embodiments of the invention only and not for purposes of limiting the same, FIG. 1 shows a transformer depicted generally at 10. The transformer 10 may be relatively compact and constructed for installation in applications having limited space, for example, as may be found on circuit boards used in machine control or other applications, not shown in the Figures. Examples of other applications may include power supplies, which may be switching power supplies, used in machinery like that of a welding machine. However, the transformer 10 of the embodiments of the subject invention may be utilized in any device or machine chosen with sound engineering judgment. Accordingly, the transformer 10 may be thin, compact and relatively light weight, herein referred to as a planar transformer 10, and may be mountable onto a circuit board or structural member by way of fasteners or other means.

Figure 2:
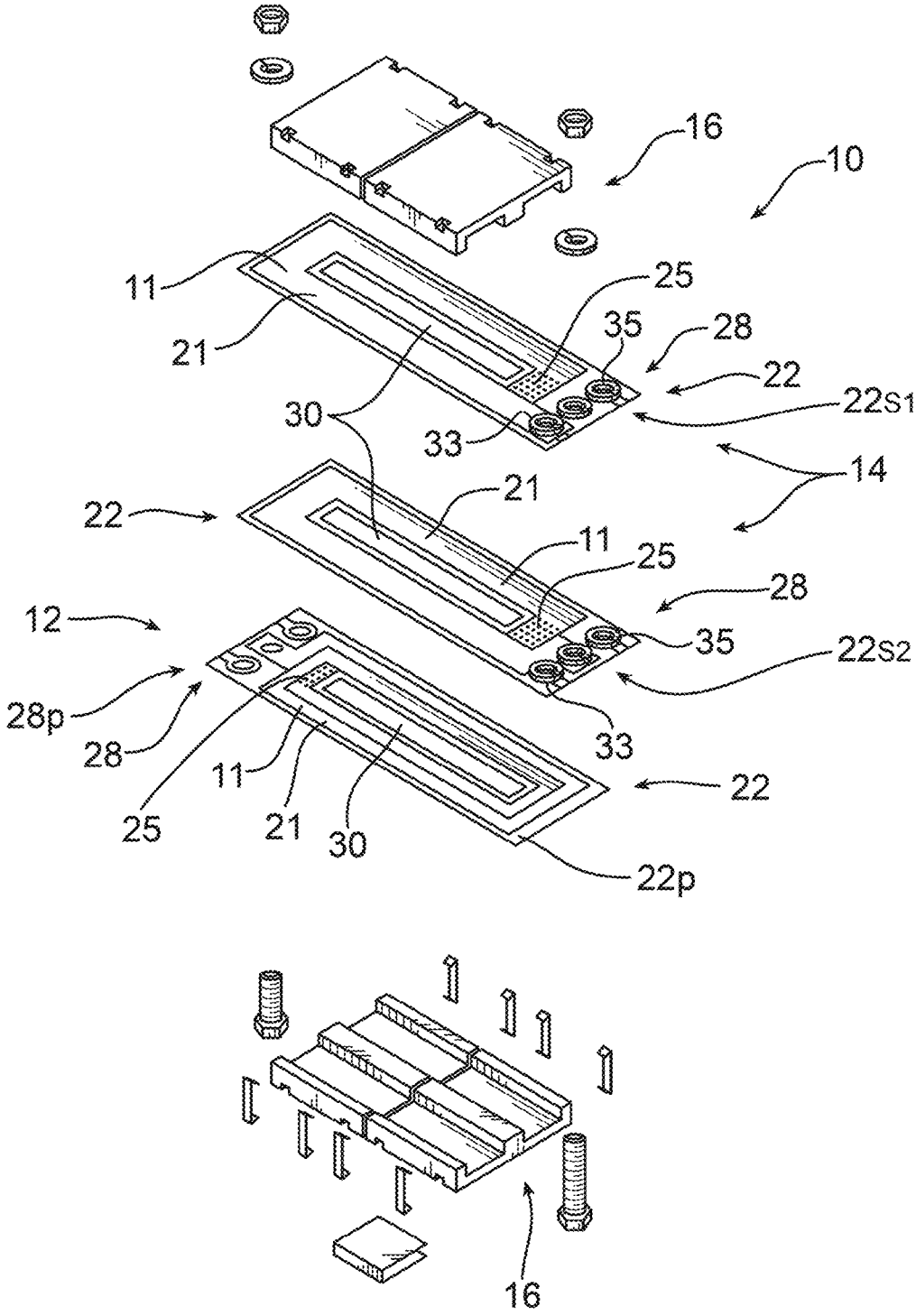
FIG. 2 is an expanded view of one embodiment of the planar transformer of FIG. 1, showing the components of the planar transformer, according to the embodiments of the subject invention.

Referring to FIG. 2, the transformer 10 includes electrical conductive pathways 11 that comprise primary 12 and secondary 14 windings. The windings 12, 14 are coupled via a transformer core 16, also known as core 16, that conveys magnetic flux between the windings 12, 14. The core 16 may be made from a ferromagnetic material as will be discussed further in a subsequent paragraph. To facilitate the compact design of the transformer 10, the electrically conductive pathways 11 may be generally planar, which is to say that the electrically conductive pathways 11 may have a thin and generally rectangular cross section, although the particular geometric configuration of the electrically conductive pathways 11 is not to be construed as limiting. In one embodiment, electrically conductive pathways 11 may be formed respectively on insulating substrates as electrical traces 21, or electrically conductive traces 21, and in particular may be etched onto a circuit board 22 by way of processes known in the art. Still, any manner of constructing electrical conductive pathways 11 may be chosen with sound engineering judgment. In an exemplary manner, the electrical traces 21 may be etched into one or both sides of the circuit board 22. In the specific instance of a circuit board 22 having electrical traces 21 etched into both sides of the planar substrate, electrical connection therebetween is accomplished by the use of vias 25, which may be copper coated, extending through the substrate. Additionally, the electrically conductive pathways 11 may terminate at connector ends 28, which may be grouped together at one side of the substrate forming terminals for electrical connection to other circuits.

The electrical traces 21 may be covered with a coating that inhibits electrical discharge between circuits. The coating may therefore comprise a dielectric coating, which in one embodiment, is made from a polyimide. The circuit board 22 may also be covered with an additional sheet of insulating material. As will be discussed below, multiple circuit boards 22 used in the planar transformer 10 may each be covered with an additional sheet of insulating material, wherein the insulating sheets are interleaved to restrict fluids and/or debris from establishing an electrical connection between the circuit boards.

With continued reference to FIG. 2, the electrically conductive pathways 11, and more specifically the electrical traces 21, may be arranged on the circuit boards 22 in a coiled manner so as to concentrate lines of magnetic flux generated by the flow of electrical current. It is expressly noted here that any number of coils, i.e. coiled electrical traces 21, may be incorporated onto a single circuit board 22 as is appropriate for determining the turns ratio of the planar transformer 10, which may be adjustable for a fixed set of planar transformer components. In this manner, the coiled electrical traces 21 may surround an aperture 30 formed in the substrate, which may be the insulating material of the circuit board 22, for receiving the core 16 as mentioned above. Magnetic flux is therefore conveyed from a first winding, e.g. the primary winding 12, to a second winding, which may be the secondary winding 14, by way of the core 16 extending through the apertures 30 of adjacently positioned circuit boards 22. The number and shape of the apertures 30, as well as the corresponding core 16, depicted in the Figures is exemplary in nature. It is to be construed that any quantity and configuration of apertures 30 and cores 16 may be chosen without departing from the intended scope of coverage of the embodiments of the subject invention.

Figure 3:
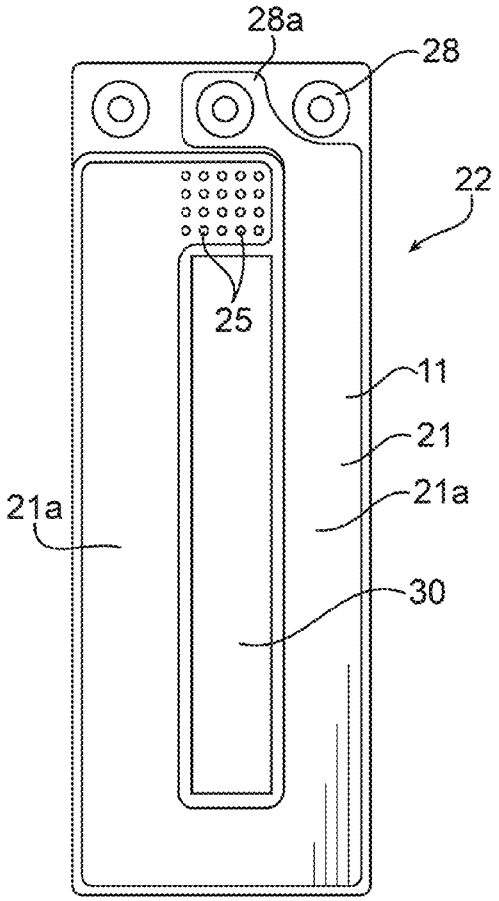
FIG. 3 is a top view of a circuit board having electrically conductive pathways fashioned on a first side thereof, according to the embodiments of the subject invention.
Figure 3A:
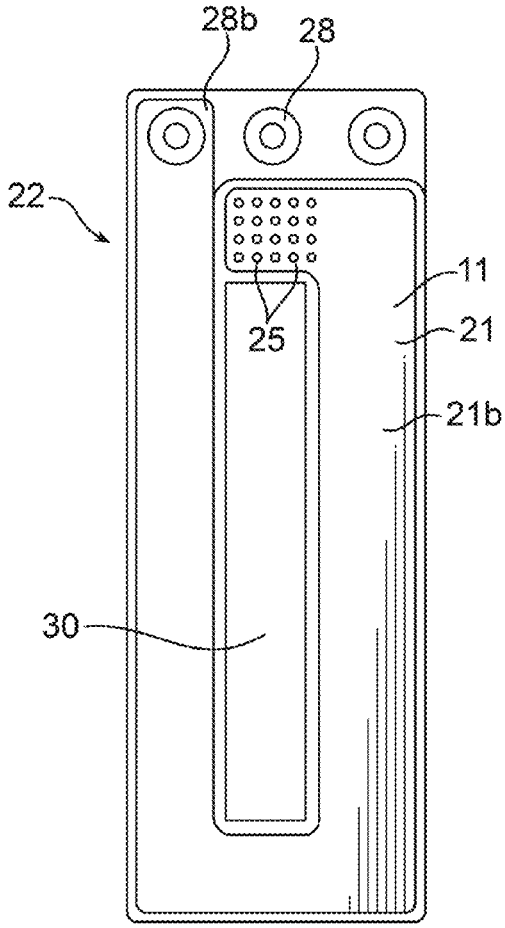
FIG. 3*a* is a bottom view of the circuit board shown in FIG. 3 having electrically conductive pathways fashioned on a second side, according to the embodiments of the subject invention.

FIGS. 3 and 3*a* show two views of a single planar circuit board 22 having electrical traces 21 fashioned on both sides. FIG. 3 depicts a first face of the circuit board 22, while FIG. 3*a* depicts the opposing face. From the illustrations, the electrically conductive pathway 11 may be traced between connector ends 28*a*, 28*b*. Referring first to FIG. 3, a first electrical trace 21*a* begins with connector end 28*a*, and traverses in a clockwise manner around the first face of circuit board 22 thereafter ending at vias 25, which connect the first electrical trace 21*a* with a second electrical trace 21*b*, shown in FIG. 3*a*. The second electrical trace 21*b* continues in a clockwise manner and correspondingly terminates at connector end 28*b*. In this particular embodiment, circuit board 22 incorporates two coiled, electrically conductive pathways 11, which may be used in constructing at least a portion of the windings 12, 14 of the planar transformer 10. Still, other quantities of coils of electrically conductive pathways 11 may be incorporated onto a single planar circuit board 22 as chosen with sound engineering judgment, including but not limited to odd numbers of electrically conductive pathways 11.

With continued reference to FIGS. 2 through 3*a*, the planar transformer 10 may be assembled using a plurality of circuit boards 22. More specifically, the primary 12 and/or secondary winding 14 may respectively be constructed using one or more circuit boards 22 connected in either a series or a parallel configuration. In one embodiment, shown in FIG. 2, the primary winding 12 may comprise the single planar circuit board $\mathbf{22}_p$, having any number of layers. Connector ends $\mathbf{28}_p$ may be connected, for example, to the output of a power supply for example, or other circuitry, not shown in the Figures. Moreover, the secondary winding 14, in one exemplary manner, may be comprised of two circuit boards $\mathbf{22}_{s1}$ and $\mathbf{22}_{s2}$, also having any number of layers, the output of which may similarly be communicated to one or more various electrical circuits, also not shown. The circuit boards $\mathbf{22}_p$, $\mathbf{22}_{s1}$ and $\mathbf{22}_{s2}$ are received onto core 16 in a manner consistent with that described herein and may be juxtaposed to each other for electrical connection together, as will be described below.

In a first configuration, circuit boards $\mathbf{22}_{s1}$, $\mathbf{22}_{s2}$ are connected together in series, which is to say that the electrical traces 21 of each circuit board is sequentially connected. Stating it another way, the circuit boards $\mathbf{22}_{s1}$, $\mathbf{22}_{s2}$ are oriented so that the coiled electrical traces 21 combine or add to increase the number of turns on the secondary winding 14. Of course, similar configurations may be implemented for the primary winding 12 as well without departing from the intended scope of coverage of the embodiments of the present invention. Alternatively, circuit boards $\mathbf{22}_{s1}$, $\mathbf{22}_{s2}$ may be connected in parallel, in a second configuration, wherein the coiled electrical traces 21 function to redundantly pick up magnetic flux as opposed to the amplifying effect of the previous configuration. This effectively distributes the current over multiple electrical traces 21. Accordingly, as will be recognized by one of ordinary skill in the art, changing the specific arrangement of the circuit boards and the connection between connector ends results in a change of the turns ratio of the planar transformer 10. It is noteworthy to mention that the turns ratio of the planar transformer 10 is adjustable without interchanging components of the planar transformer, for example circuit boards. It will be realized that one way of changing the turns ratio of the planar transformer 10 is to invert one circuit board with respect to another circuit board, whereafter the circuit boards can then be electrically connected as will be discussed in the following paragraph.

Figure 4:
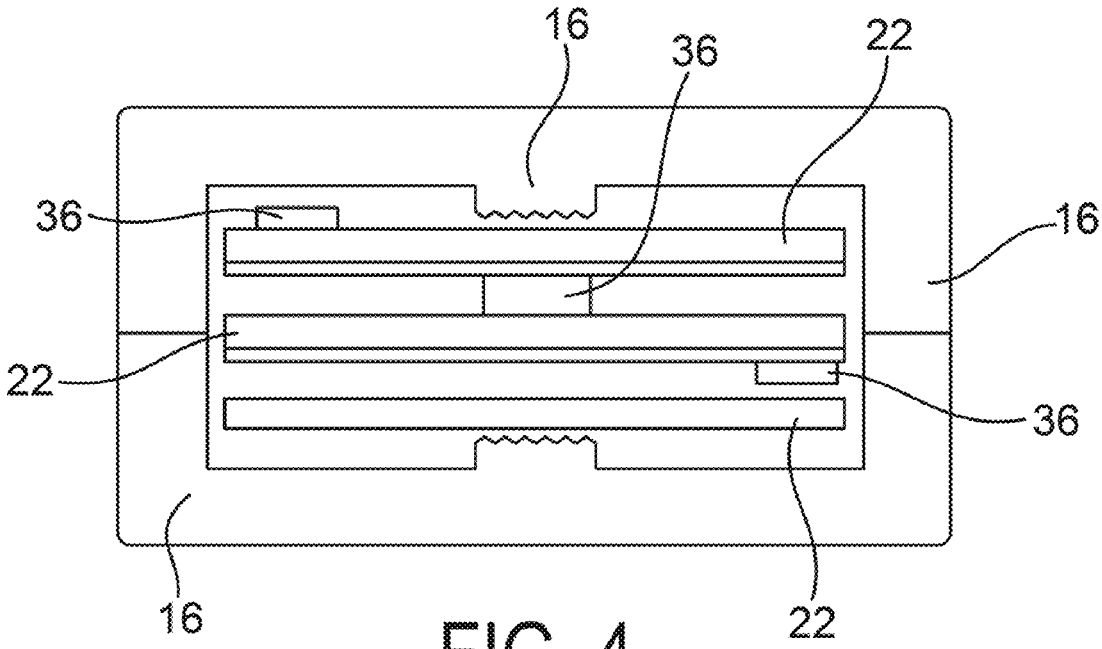
FIG. 4 is a schematic representation of an end view of the transformer showing the circuit boards positioned together around a core, according to the embodiments of the subject invention.

With reference again to FIGS. 2, 3 and 3*a*, and now also to FIG. 4, as previously described, connector ends 28 of a particular circuit board 22 may be grouped together substantially at one end of the circuit board 22. The circuit boards 22 may be arranged so that collectively the connector ends 28 of a particular winding 12 or 14 are grouped together in an array substantially at one side of the planar transformer 10. The connector ends 28 may therefore respectively comprise first and second arrays of connector terminals. In one embodiment, the connector ends 28 of the primary winding 12 are diametrically positioned with respect to the connector ends 28 of the secondary winding 14. Although alternative arrangement may be chosen for positioning one group of connector ends 28 with respect to another group of connector ends 28. It will be readily seen then that the connector ends 28 of a particular winding 12 or 14, may be proximally positioned, and more specifically aligned in a stacked relationship, when the circuit boards 22 are assembled onto the core 16. Accordingly, the individual electrical traces 21 may be electrically connected together, whether in parallel or in series, by the arrangement of means 33 for electrical connecting the electrical traces 21 together.

Means 33 for electrically connecting the traces together may incorporate conductive connectors 35 that bridge the electrical connection between connector ends 28 of respective circuit boards 22. The conductive connectors 35 may be affixed to the connector ends 28 by way of soldering, for example. Alternatively, the conductive connectors 35 may mechanically crimp, clip or positively lock onto the connector ends 28. However, any manner of securing the conductive connectors 35 and the respective connector ends 28 may be chosen with sound judgment. It follows that the conductive connectors 35 may also span the gap between connector ends 28, which is to say between circuit boards 22. As such, conductive connector 35 may be constructed having a thickness corresponding to the distance between connector ends 28 and/or circuit boards 22. The width of the conductive connectors 35 may correspond to the thickness of the substrate comprising the circuit board 22, as well as the thickness and/or arrangement of insulating material 40 between circuit boards 22. Still, the conductive connectors 35 may be constructed having any dimension suitable for electrically communicating the electrical traces 21 of one circuit board 22 with that of another. In one embodiment, electrical connecting means 33 may comprise conductive spacers 36 that fit in the space between connector ends 28 and may be generally disk shaped having first and second generally flat surfaces that abut the surface of the connector ends 28 of adjacently positioned circuit boards 22.

Figure 5:
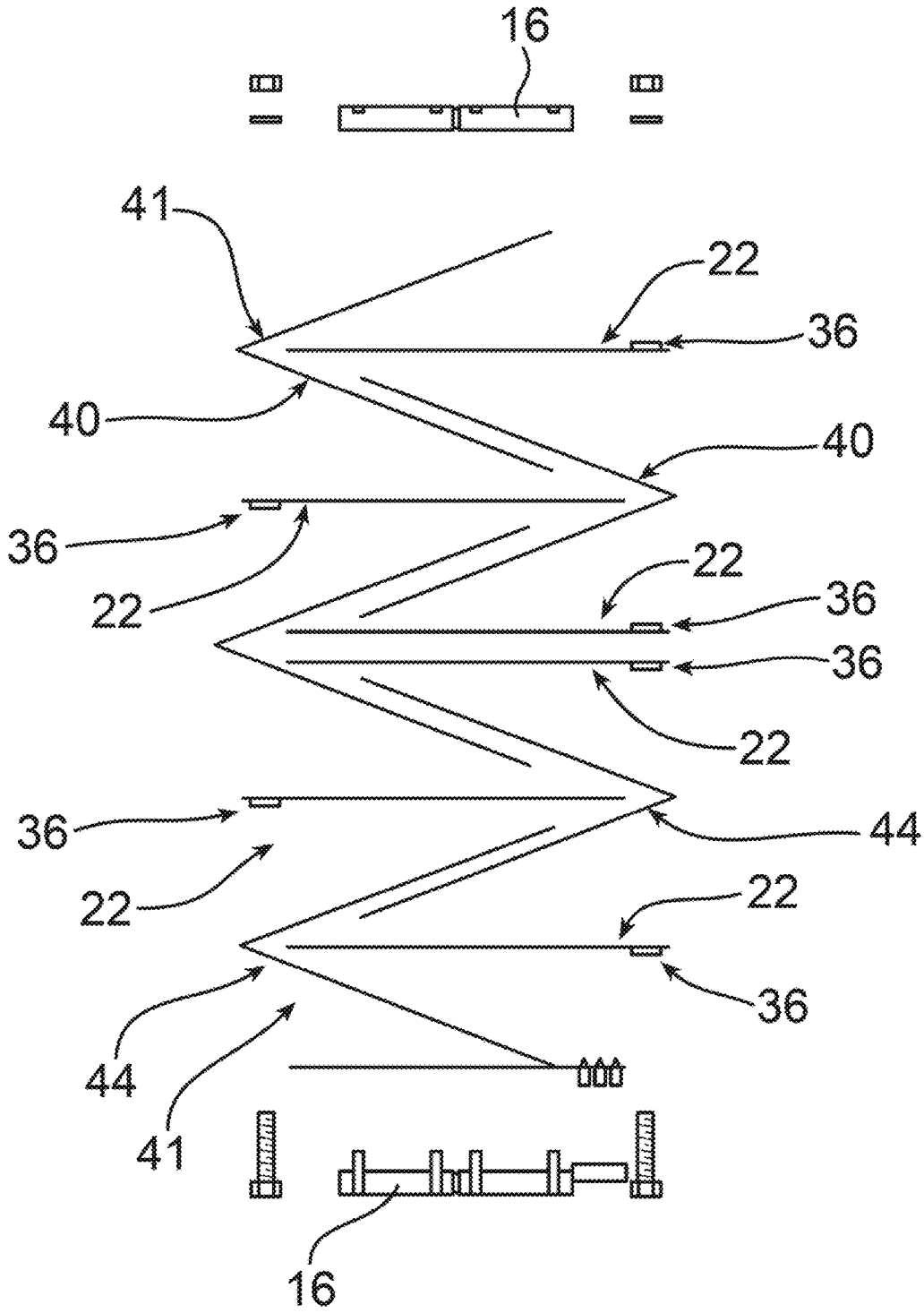
FIG. 5 is a schematic representation of an expanded view of another embodiment of the planar transformer of FIG. 1, showing the insulating sheets and other various components of the planar transformer, according to the embodiments of the subject invention.

Referring now to FIG. 5, as mentioned above, the first 12 and second winding 14 of the planar transformer 10 may be constructed by positioning respective circuit boards 22 onto core 16 in a stacked relationship. Accordingly, each of the circuit boards 22 may be separated by insulating material 40 and thereby isolated from inadvertent electrical contact with each other. The insulating material 40 may be comprised of a dielectric substance, which may be selected from a polymer material, such as for example Polyimide and/or Polyester. However, any composition of material suitable for restricting and/or inhibiting the flow of electrical current may be utilized. In one embodiment, multiple layers of insulating material 40 may be used to electrically isolate the electrical traces 21 including a first layer encapsulating part or all of the electrical traces 21 and the corresponding substrate and a second layer comprising sheets disposed between circuit boards 22. The second layer of insulating material 40 may be generally planar, that is to say fashioned in insulating sheets 41 having a relatively narrow thickness with respect to its surface area as defined by length and width dimensions. In one embodiment, the thickness of the insulating sheets 41 may be in the range between 0.001 inch and 0.050 inch. More specifically, the thickness of the insulating sheets 41 may be in the range of 0.001 inch to 0.010 inch. Although, the insulating sheets 41 may be sized to any thicknesses as is appropriate for the voltage requirements of the planar transformer 10. The length and width of the insulating sheets 41 may be sufficiently large to substantially cover one or both sides of a circuit board. Moreover, the surface area of the insulating sheets 41 may be larger than the surface area of the circuit boards 22 and hence overlap its edges.

Still referring to FIG. 5, the layers 41, i.e. insulating sheets 41, may be fashioned having a closed end and at least one open end thereby forming an insulating sleeve 44 that receives circuit board 22. It will be appreciated that each individual circuit board 22 may be covered by a separate insulating sleeve 44. In this manner, the insulating sleeves 44 overlap to provide multiple barrier layers between the circuit boards 22. It is noted that the layers 41 function, not only to prevent electrical discharge between the electrical traces 21, but may also function to inhibit water from flowing between circuit boards 22, and more specifically from between the conductive connectors 35. In one particular embodiment, the orientation of the insulating sleeves 44 may be staggered or alternated whereby the closed end of one insulating sleeve 44 faces a distal or opposite direction with respect to the closed end of the insulating sleeve 44 of an adjacent circuit board 22. Accordingly, water tracking between the primary 12 and secondary windings 14 of the planar transformer 10 will be restricted or substantially eliminated. In this manner, the insulating sleeves 44 may be interleaved to prevent electrical discharge between electrical traces 21.

With reference to FIGS. 2 through 5, construction of the planar transformer 10 will now be described. As mentioned above and as depicted in the Figures, core 16 is proximally positioned near electrical traces 21 of the circuit boards for communicating magnetic flux between windings 12, 14. In one embodiment, the core 16 extends through apertures 30 formed in the circuit boards 22 as described above and may extend around the exterior of the circuit boards 22 as well. In this manner, magnetic flux may be communicated between windings 12, 14 through the material comprising the core 16. An example of core material may include but is not limited to carbon based steel. However, other types of ferromagnetic material and even non-ferromagnetic materials may be chosen. A first circuit board 22*a* may be placed onto the core 16 having connector ends 28*a* positioned substantially at one side of the planar transformer 10. In an exemplary manner, the first circuit board 22*a* may comprise the first winding 12. Subsequently, second circuit board 22*b* may be inserted onto core 16 having connector ends 28*b* distally positioned from the first side, i.e. facing in a second or opposite direction. In one embodiment, another circuit board 22*c* may further be installed similarly having connector ends 28*c* juxtaposed to those of circuit board 22*b*. To construct the secondary winding 14, in this case, conductive spacers 36 are installed between connector ends 28*b*, 28*c* so as to electrically connect the electrical traces 21 thereby forming the secondary winding 14.

The orientation of the circuit boards 22*b*, 22*c* may be changed to alter the turns ratio of the planar transformer 10 without the need to construct or install a differently designed circuit board 22, that is to say a circuit board having a different pattern or number of coiled electrical traces 21. Moreover, the turns ratio of the planar transformer 10 may be changed without adding additional circuit boards. Rather, the turns ratio of the planar transformer 10 may be altered by reorienting the circuit boards. More specifically, the turns ratio may be altered by reorienting or rearranging the circuit boards of a particular winding 12 or 14. Reorienting may refer to the direction that a particular circuit board faces, with respect to an adjacently connected circuit board, or may refer to the parallel or series connection between circuit boards of a common winding 12 or 14. As such, the user has the option of adjusting the turns ratio simply by orienting the components of the planar transformer 10. Procedurally, the user need only rearrange the planar transformer so that the proximal face of one circuit board 22*b* faces away from an adjacently positioned circuit board 22*c* and reconnect the conductive spacers 36 accordingly thereby changing the electrical connection between electrical traces 21 and hence the turns ratio. It is to be construed that the turns ratio may be altered on either or both the primary and secondary side of the planar transformer 10.

With reference again to FIGS. 1 and 2*a*, another embodiment of the subject invention will now be discussed. The planar transformer 10 may incorporate one or more auxiliary windings 50, or auxiliary winding circuits. Auxiliary winding 50 may be constructed on a separate circuit board 51, i.e. separate from that of the primary and secondary windings 12, 14, but electromagnetically coupled with the primary and/or secondary windings 12, 14 via the transformer core 16. In a manner similar to that previously described, the auxiliary circuit board 51 may be formed by etching electrically conductive pathways 11 or traces of copper (or other suitable material) onto a non-conductive substrate, which may be fashioned in a coiled manner for increasing or decreasing the turns ratio respective of the primary winding 12. Any number of auxiliary winding coils may be included for setting a particular voltage and/or current output at the auxiliary winding terminals 58. The traces may be fashioned on one or both sides of the substrate, again similar to that described above. It is noted here that while the auxiliary winding(s) 50 are described as being coiled, it is to be construed that other patterns of forming the auxiliary winding circuit may be chosen without departing from the intended scope of coverage of the embodiments of the subject invention.

Figure 2A:
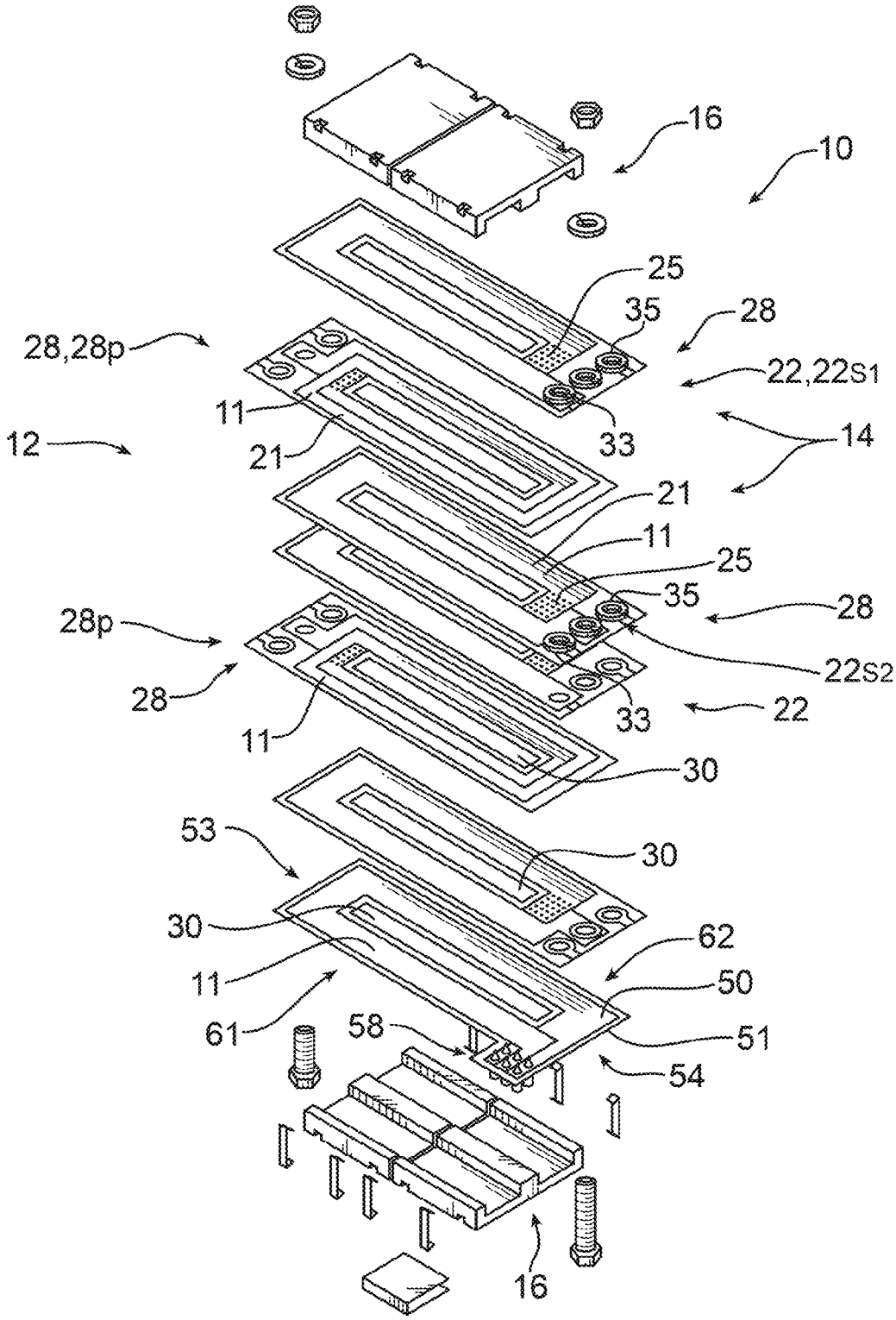
FIG. 2*a* is an expanded view of one embodiment of the planar transformer of FIG. 1, showing the components of the planar transformer, according to the embodiments of the subject invention.

The terminals 58, also referred to herein as connector ends 58, of the electrical conductive pathways 11 for the auxiliary circuit board(s) 51 may reside on a side or edge of the auxiliary circuit board 51 distinctive from that of the terminal ends or connector ends of the primary and secondary windings 12, 14. In other words, the electrical connection points of the auxiliary winding(s) 50 may be offset with respect to the connection points, or connector ends 28, of the primary and secondary windings 12, 14. In one embodiment, the circuit boards 22, 22*a*, 22*b*, 22*c*, 22*p*, 22*s*1, 22*s*2, 51 may be generally longitudinal or oblong having a major and a minor axis. It will be seen that the circuit boards are aligned longitudinally onto the core 16. Stated differently, the longitudinal axes of the circuit boards are aligned with respect to a longitudinal axis of the core 16. First and second ends 53, 54 of the planar transformer 10, along with the various auxiliary circuit board(s) 22, 22*a*, 22*b*, 22*c*, 22*p*, 22*s*1, 22*s*2, 51, are accordingly defined as those edge portions residing on diametrically opposed ends of the major axis. It follows that sides 61, 62 of the planar transformer 10 are defined as distal ends of the minor axis. Thus, the connector ends 28 of the primary and secondary windings 12, 14 reside substantially at the first and second ends 53, 54, while connector end 58 of the auxiliary circuit board(s) 51 may extend from one of the sides 61, 62 thereby offsetting the connection points of the auxiliary winding(s) 50. Illustratively, FIG. 2*a* shows connector end 58 fashioned on a first side 61 of the auxiliary circuit board 51. In this instance, the connector end 58 resides not only on one side 61 of the auxiliary circuit board 51, but it is also positioned proximal to one particular end 54 on the planar transformer 10. Other embodiments are contemplated wherein the connector end 58 is positioned at a midpoint of the sides 61, 62. In either case, access to the connector end 58 of the auxiliary winding 50 can be made from a direction that does not interfere with connecting to the primary and secondary windings 12, 14. It is to be construed that any position along the sides 61, 62 of the auxiliary circuit board 51 may be chosen for positioning connector ends 58.

Figure 6:
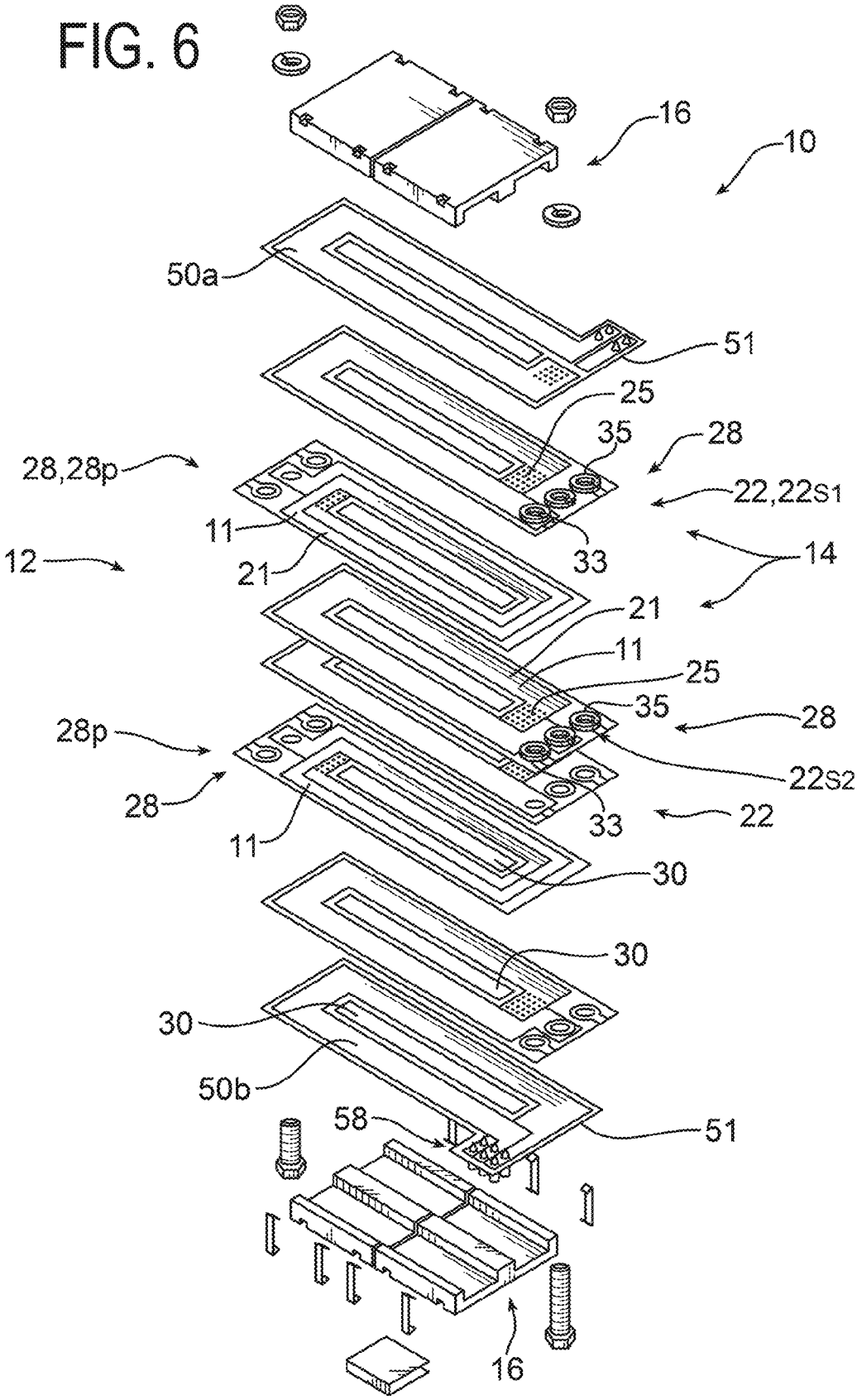
FIG. 6 is an expanded view of another embodiment of the planar transformer, showing the components of the planar transformer, according to the embodiments of the subject invention.

Referring to FIG. 6, multiple auxiliary windings 50 may be incorporated into the planar transformer 10. In one particular embodiment, first and second auxiliary windings 50*a*, 50*b* are included. The respective connector ends 58*a*, 58*b* may extend from opposite sides 61, 62 of the auxiliary circuit boards 51. One auxiliary winding 50*a* may have a different number of electrical traces or coils than the other auxiliary winding 50*b* thereby supplying auxiliary power of different magnitudes for use by different circuits. In an exemplary manner, the first auxiliary winding 50*a* may have a complimentary number of coiled traces to produce 300 volts, with respect to the primary winding 12. Similarly, auxiliary winding 50*b* may have traces for providing 48 volts. However, any combination or variation in the number of coiled traces in the first and second auxiliary windings may be utilized as is appropriate for use with the embodiments of the subject invention.

Figure 7:
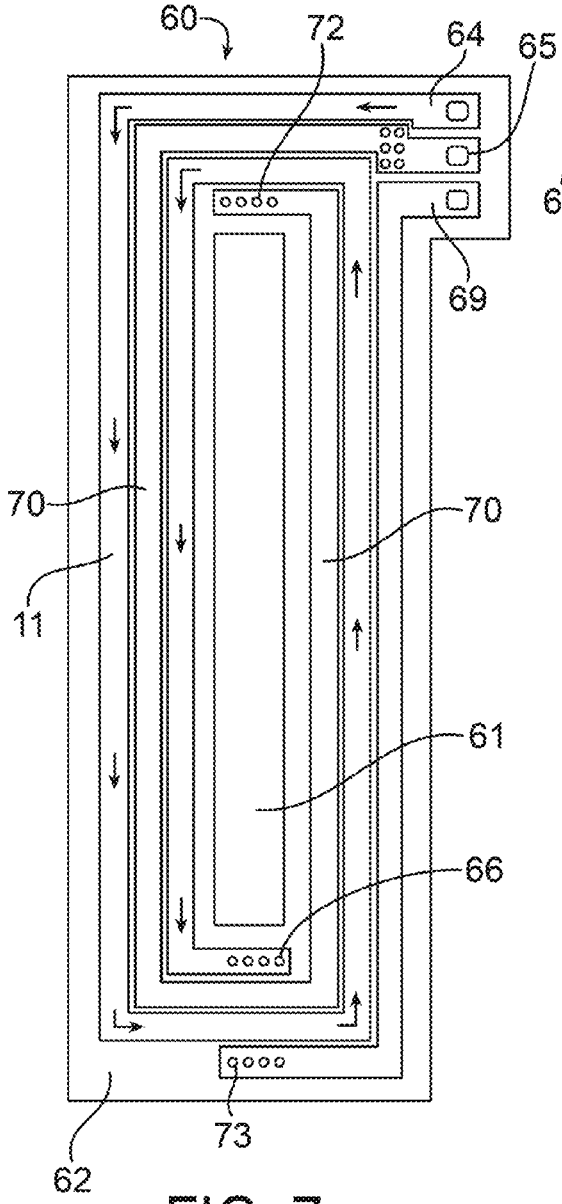
FIG. 7 is a top view of one embodiment of a circuit board, according to the embodiments of the subject invention.
Figure 7A:
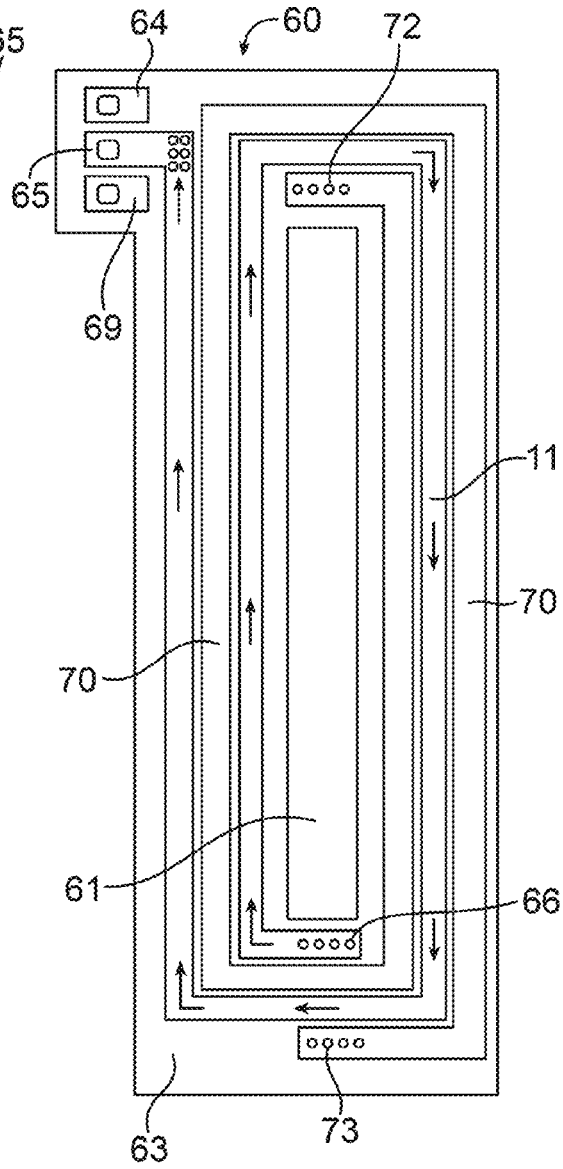
FIG. 7*a* is a bottom view of the circuit board shown in FIG. 7, according to the embodiments of the subject invention.

As mentioned above, the circuit boards of the planar transformer 10 may include coiled electrically conductive pathways having an odd number of turns. For reference purposes, FIG. 7 shows one side 62 of a circuit board 60 for planar transformer 10 and FIG. 7*a* shows the opposite side 63 on the same circuit board 60. In an exemplary embodiment, circuit board 60 includes three electrically conductive pathways 11 coiled around aperture 61. It is noted that at least one of the coil turns is divided between first 62 and second 63 sides of the same circuit board 60, which is in contrast to odd numbers of coiled traces formed on a single side of the circuit board. In this way, part of the coiled trace is formed on one side of the circuit board 60 and the remaining portion is formed on the opposite side. Connection therebetween is made by vias 66 extending through the circuit board substrate. For example, in a first conductive pathway 11, an odd number of traces is connected between two particular connector ends 64, 65. Beginning on FIG. 7 with connector end 64, the first electrically conductive pathway can be followed counterclockwise one and a half turns to vias 66, which transfers through to the opposite side of the circuit board 60. From the vias 66 shown in FIG. 7*a*, the same electrically conductive trace 11 is now traversed clockwise, one and a half coiled turns to connector end 65, resulting in an odd number of turns, e.g. three (3). Other quantities of odd numbers of coiled traces may be incorporated in the circuit boards 60 as chosen with sound engineering judgment. Furthermore, persons of ordinary skill in the art will understand the application to any quantity of coiled traces, odd or even, limited only by the surface area of the circuit board. It is noteworthy to mention that while the circuit board shown in the present embodiment may resemble an auxiliary circuit board, application may be made to any of the circuit boards incorporated into the planar transformer 10.

Additionally, multiple sets of traces may be incorporated onto circuit board 60, which may be interleaved, providing the option of connecting to a first turns ratio, having an odd number of coiled traces, or to a second turns ratio having an increased number of coiled traces, which may be twice the quantity of the odd number of traces. With continued reference to FIGS. 7 and 7*a*, the multiple sets of traces may be connected to different sets of connector ends 64, 65, 69. Trace 11, as discussed above, includes three (3) distinct coils, as determined by the connection between connector ends 64 and 65. However, a second trace 70 may be accessed by an electrical connection between connector ends 65 and 69. The following example illustrates. Trace 70 may include another set of three coils, which may be interleaved with trace 11. That is to say that segments of one trace, e.g. trace 11, may be formed in between segments of the other trace, e.g. trace 70. Trace 70 may be followed beginning at connector end 65 in FIG. 7. Moving counterclockwise, trace 70 forms one coil ending at vias 72, which similarly extends through the substrate. The pathway continues on FIG. 7*a* at vias 72 and now traverses clockwise to vias 73. It will be seen that this segment of trace 70 includes approximately one and one half coil turns. The vias 73 again extend through the substrate where the final portion of the trace 70 terminates at connector end 69. From the aforementioned, it will be readily seen that connection between connector ends 64 and 65 results in a different turns ratio than connection between 64 and 69; three and six turns respectively. In this manner, a single circuit board 60 provides the option of connecting odd or even numbers of coiled turns. It is noted that the first and second sets of connector ends include at least one common terminal.

The invention has been described herein with reference to the disclosed embodiments. Obviously, modifications and alterations will occur to others upon a reading and understanding of this specification. It is intended to include all such modifications and alterations insofar as they come within the scope of the appended claims or the equivalence thereof.

What is claimed is:

1. A planar transformer, comprising:

a primary transformer winding having a first quantity of coiled electrically conductive traces formed in a nonconductive substrate that defines a first generally planar circuit board, wherein the first generally planar circuit board is elongate and includes a major and a minor axis;

a second transformer winding having a second different quantity of coiled electrically conductive traces formed in a nonconductive substrate that defines a second generally planar circuit board, wherein the second generally planar circuit board is elongate and includes a major and a minor axis;

an auxiliary transformer winding having coiled electrically conductive traces formed in a nonconductive substrate that defines a third generally planar circuit board, wherein the third generally planar circuit board is elongate and includes a major and a minor axis;

means for magnetically coupling the primary transformer winding and the second transformer winding and the auxiliary transformer winding, wherein the first, second and third generally planar circuit boards are received onto a transformer core in a configuration aligning the respective major axes;

a first set of connector ends electrically connected to the primary transformer winding, wherein the first set of connector ends extends from one end of the aligned major axes;

a second set of connector ends electrically connected to the second transformer winding, wherein the second set of connector ends extends from a distal end of the aligned major axes, wherein the first and second set of connector ends are grouped substantially together at one side of the primary and second transformer windings; and, a third set of connector ends electrically connected to the auxiliary transformer windings, wherein the third set connector ends extends from one side of the aligned minor axes, wherein the third set of connector ends is offset with respect to the first and second set of connector ends.

2. The planar transformer as defined in claim 1, wherein the third set of connector ends extends from one side of the minor axes and is positioned closer to the second set of connectors ends than to the first set of connectors ends.

* * * * *